US005974367A

United States Patent [19]

Bianco

[11] Patent Number: 5,974,367

[45] Date of Patent: Oct. 26, 1999

[54] ELECTRONIC LOCK SYSTEM AND USE THEREOF

[76] Inventor: James S. Bianco, 217 Brainard Rd., Enfield, Conn. 06082

[21] Appl. No.: 09/090,480

[22] Filed: Jun. 4, 1998

Related U.S. Application Data

[60] Division of application No. 08/510,486, Aug. 2, 1995, Pat. No. 5,816,083, which is a continuation-in-part of application No. 08/395,417, Feb. 27, 1995, abandoned, which is a continuation-in-part of application No. 07/985,840, Dec. 3, 1992, abandoned, which is a continuation-in-part of application No. 07/921,418, Jul. 27, 1992, abandoned, which is a continuation-in-part of application No. 07/780,155, Oct. 21, 1991, abandoned.

[51] Int. Cl.[6] ..... E05B 47/00

[52] U.S. Cl. ..... 702/182; 70/338; 70/263; 340/531; 340/825.31

[58] Field of Search ..... 702/182, 187; 70/263, 284, 338, 433, 379 R, 379 A, 380, 278, 279, 283, 462; 340/505, 506, 531, 555, 825.31; 235/382, 130 R

[56] References Cited

U.S. PATENT DOCUMENTS

| | | | |
|---|---|---|---|
| 4,947,163 | 8/1990 | Henderson et al. | 340/825.31 |
| 4,988,987 | 1/1991 | Barrett et al. | 340/825.31 |
| 5,140,317 | 8/1992 | Hyatt, Jr. et al. | 340/825.31 |
| 5,259,491 | 11/1993 | Ward, II | 194/350 |
| 5,349,345 | 9/1994 | Vanderschel | 340/825.31 |
| 5,351,042 | 9/1994 | Aston | 340/825.31 |
| 5,415,264 | 5/1995 | Menoud | 194/217 |
| 5,442,348 | 8/1995 | Mushell | 340/932.2 |
| 5,541,581 | 7/1996 | Trent | 340/825.31 |
| 5,552,777 | 9/1996 | Gokcebay et al. | 340/825.31 |
| 5,691,711 | 11/1997 | Jorgensen | 340/825.31 |
| 5,701,828 | 12/1997 | Benore et al. | 109/56 |
| 5,745,044 | 4/1998 | Hyatt, Jr. et al. | 340/825.31 |
| 5,768,379 | 6/1998 | Girault et al. | 380/21 |
| 5,771,176 | 6/1998 | Froehlich et al. | 364/505 |
| 5,774,058 | 6/1998 | Henry et al. | 340/825.31 |
| 5,774,059 | 6/1998 | Henry et al. | 340/825.31 |
| 5,791,177 | 8/1998 | Bianco | 70/278 |
| 5,816,083 | 10/1998 | Bianco | 70/278 |
| 5,826,450 | 10/1998 | Lerchner et al. | 70/278 |

*Primary Examiner*—Patrick Assouad
*Attorney, Agent, or Firm*—John H. Crozier

[57] ABSTRACT

In a preferred embodiment, with a system employing an electronic lock and electronic key apparatus, a method, including: providing as the electronic key apparatus an electronic key selected from the group consisting of a master key, and audit key, and a service key; when the master key is selected as the electronic key apparatus; connecting the master key to the electronic lock; then, the electronic lock inquiring as to status of the master key to determine if the master key is a valid master key; and then, when valid, the master key causing a password to be written to a memory in the electronic lock; when the audit key is selected as the electronic key apparatus; connecting the audit key to the electronic lock; then, the audit key transmitting a password to the electronic lock; and then, provided the audit key has presented a valid password to the electronic lock, the electronic lock transmitting to the audit key first identification information; and, when the service key is selected as the electronic key apparatus; connecting the service key to the electronic lock; then, the service key transmitting to the electronic lock second identification information; and then, the electronic lock becoming unlocked.

7 Claims, 5 Drawing Sheets

ELECTRONIC LOCK SYSTEM AND USE THEREOF

CROSS-REFERENCE TO RELATED APPLICATIONS

The present application is a division of application Ser. No. 08/510,486, filed Aug. 2, 1995, now U.S. Pat. No. 5,816,083, issued Oct. 6, 1998, which is a continuation-in-part of co-pending application Ser. No. 08/395,417, filed Feb. 27, 1995, abandonded which is a continuation-in-part of application Ser. No. 07/985,840, filed Dec. 3, 1992, abandoned, which is a continuation-in-part of application Ser. No. 07/921,418, filed Jul. 27, 1992, abandoned, which is a continuation-in-part of application Ser. No. 07/780,155, filed Oct. 21, 1991, abandoned, the disclosures of which are incorporated by reference hereinto.

BACKGROUND OF THE INVENTION

1. Field of the Invention.

The present invention relates to lock systems generally and, more particularly, but not by way of limitation, to a novel electronic lock system which is especially useful in monitoring use of the lock.

2. Background Art.

In many situations, it would be desirable to have a record of who opened a lock, when the lock was opened, and for how long the lock was opened. One such situation, for example, is access to slot machine mechanisms.

Accordingly, it is a principal object of the present invention to provide a lock system which is capable of monitoring use of a lock.

It is a further object of the invention to provide such a lock system which can record who opened a lock, when the lock was opened, and for how long the lock was opened.

It is an additional object of the invention to provide such a lock system that is compact and can be easily retrofitted to systems in which mechanical key locks are employed.

It is another object of the invention to provide such a lock system which is economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing in a preferred embodiment, with a system employing an electronic lock and electronic key means, a method, comprising: providing as said electronic key means an electronic key selected from the group consisting of a master key, and audit key, and a service key; when said master key is selected as said electronic key means; connecting said master key to said electronic lock; then, said electronic lock inquiring as to status of said master key to determine if said master key is a valid master key; and then, when valid, said master key causing a password to be written to a memory in said electronic lock; when said audit key is selected as said electronic key means; connecting said audit key to said electronic lock; then, said audit key transmitting a password to said electronic lock; and then, provided said audit key has presented a valid password to said electronic lock, said electronic lock transmitting to said audit key first identification information; and, when said service key is selected as said electronic key means; connecting said service key to said electronic lock; then, said service key transmitting to said electronic lock second identification information; and then, said electronic lock becoming unlocked.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
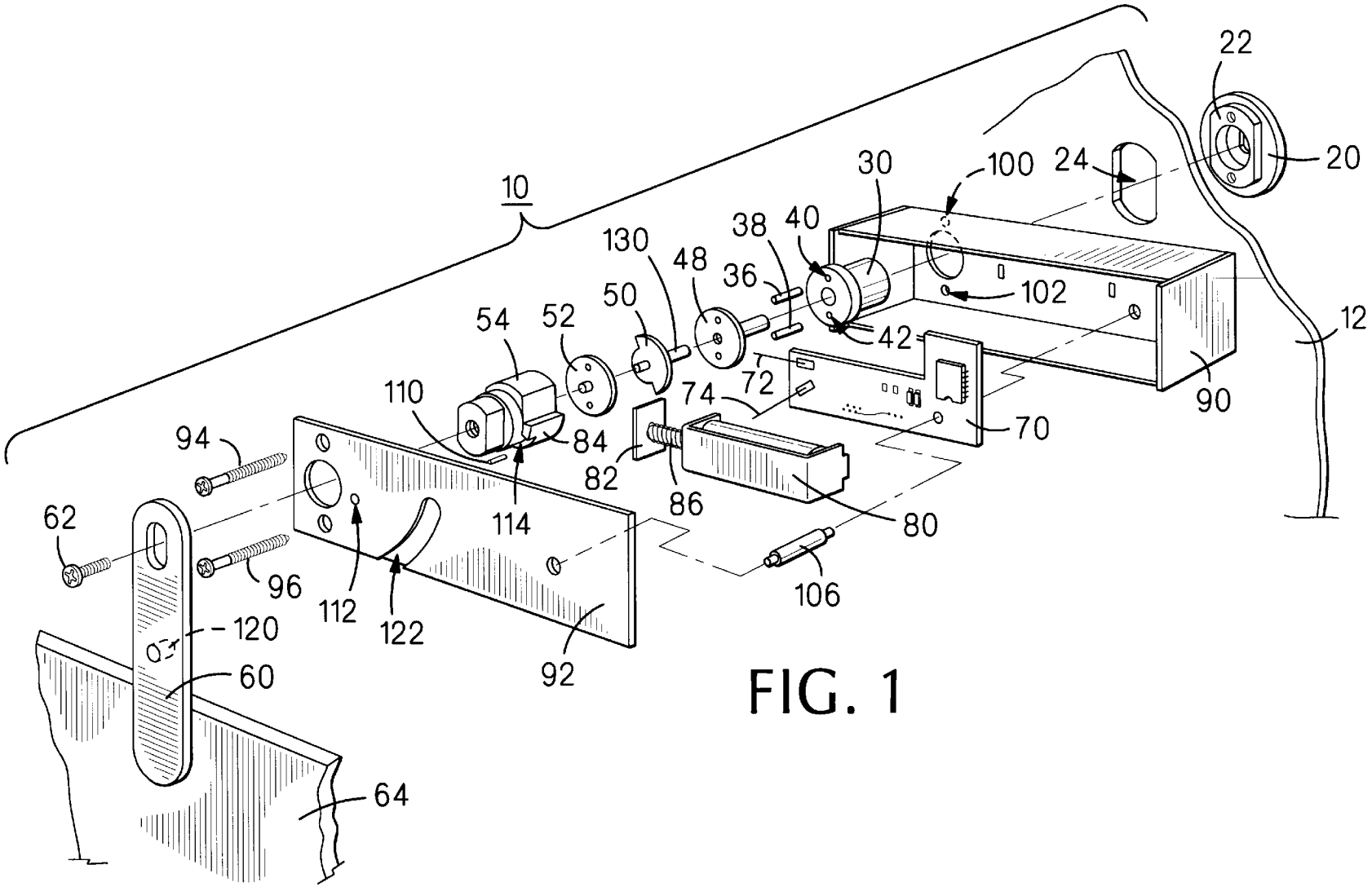
FIG. 1 is an exploded perspective view of an electronic lock constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an electronic lock constructed according to the present invention, generally indicated by the reference numeral 10, mounted, for example, to an existing cabinet door 12.

Lock 10 includes a face cover 20 having an integral rearwardly extending hub 22 which hub fits into a complementarily shaped double-D opening 24 defined in cabinet door 12 to prevent the rotation of the face cover and hub relative to the cabinet door. A cylindrical drive hub 30 is inserted into and rotates within member 22. Drive hub 30 has defined in the front portion thereof an opening (not shown) to accept therein a key or wrench (not shown) which may be the oval wrench described in the above-referenced application Ser. No. 08/395,417. Two drive pins 36 and 38 inserted into holes 40 and 42 defined in the rear face of drive hub 30 attach the drive hub to, in order, a first insulator 48, a communication plate 50, a second insulator 52, and a lock hub 54. Lock hub 54 is attached to a lock bar 60 by means of a screw 62, the lock bar engaging a surface, such as surface 64, for example, to prevent cabinet door 12 from being opened.

Lock 10 further includes a printed circuit board 70 having electronic circuitry, including a microprocessor and a non-volatile memory, mounted thereon and two contact wires 72 and 74 extending therefrom. An unlock solenoid 80 includes a lock plate 82 at the end thereof which engages a step 84 formed on lock hub 54 when lock 10 is in its locked position. A spring 86 biases lock plate 82 into the locked position when unlock solenoid 80 is unenergized.

All the components of lock 10, except for lock bar 60, are disposed in a housing 90 attached to the rear surface of cabinet door 12 and having a rear cover plate 92, the components being secured together and attached to the rear surface of the cabinet door by means of two screws 94 and 96 extending through rear cover plate 92, holes 100 and 102 defined through the front of the housing, and into the cabinet door. A spacer 106 extends between rear cover plate 92 and the front of housing 90.

Figure 2:
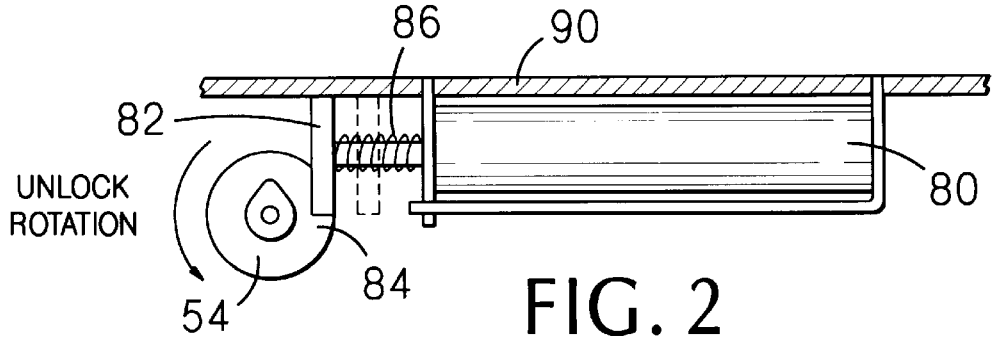
FIG. 2 is a fragmentary rear elevational view showing the latching mechanism of the electronic lock.

With reference also to FIG. 2, the action of unlock solenoid 80 is illustrated. Lock plate 82 is shown, in solid lines, engaging step 84 on lock hub 54 to prevent the rotation thereof. When unlock solenoid 80 is energized, lock plate 82 is withdrawn from engagement with step 84, as shown in broken lines, and lock hub 54 is free to rotate counterclockwise as indicated by the arrow, thus disengaging lock bar 60 (FIG. 1) from surface 64 so that cabinet door 12 may be opened.

When lock 10 is subsequently locked by rotating lock hub 54 and the other rotating members clockwise, the lock hub is stopped at its home position by means of engagement of stop plate 82 with step 84.

Figure 4:
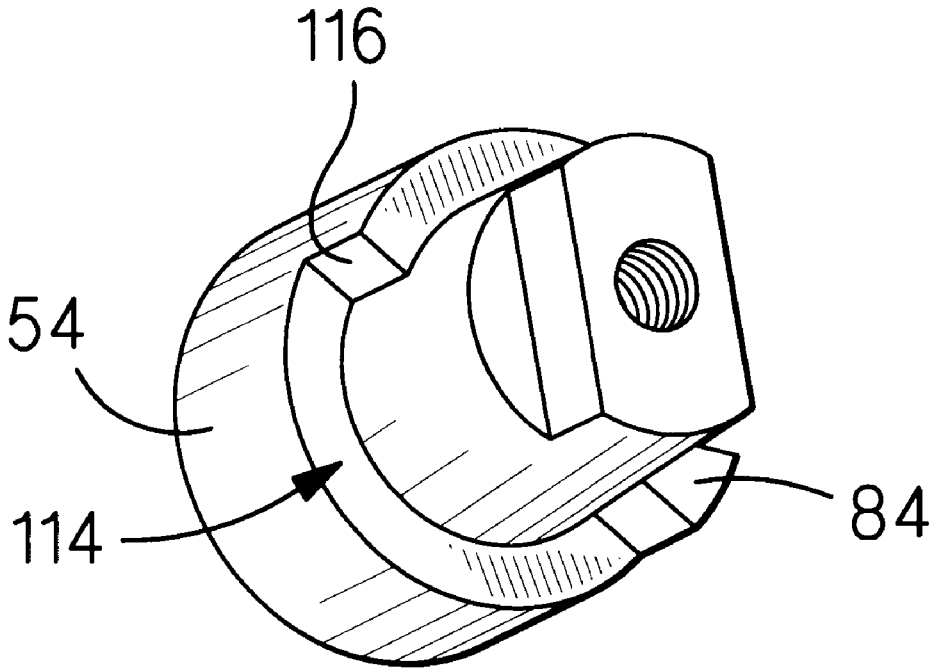
FIG. 4 is a perspective view of a component of the electronic lock.

Lock 10 is arranged so that the same components may be employed for either 90-degree or 180-degree rotation of the rotating lock members. If 90-degree rotation is desired, lock bar 60 is used in the position shown, with a stop pin 120 extending forwardly of the lock bar and engaging an arcuate channel 122 defined in the rear surface of rear cover plate 92. As lock bar 60 is rotated counterclockwise during unlocking of lock 10, stop pin 120 will enter and move within channel 122. When stop pin 120 engages the upper limit of channel 122, further counterclockwise rotation of the lock bar and the other rotating components of lock 10 past 90 degrees will be prevented. If, on the other hand, 180-degree rotation is desired, lock bar 60 is removed from lock hub 54, reversed, and reattached to the lock hub, with stop pin 120 facing rearwardly, thus permitting full rotation of the rotating members of lock 10 to the 180-degree position. The 180-degree position is determined by a rotation stop pin 110, fixed in a opening 112 defined in rear cover plate 92, engaging a channel 114 defined in lock hub 54, as is more clearly shown on FIG. 4. As will be understood from FIG. 4, counterclockwise rotation of lock hub 54 will terminate when rotation stop pin 110 engages wall 116 of channel 114. The selection of degree of rotation does not have to be made until lock 10 is being installed in the field.

Lock 10 is quite compact and can be easily retrofitted to installations where mechanical key locks were previously installed.

Figure 3A:
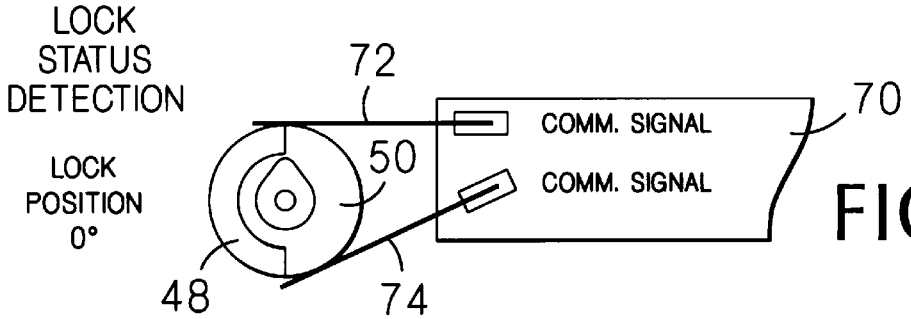
FIGS. 3A–3D are fragmentary rear elevational views showing the detection of unlocking of the lock.
Figure 3B:
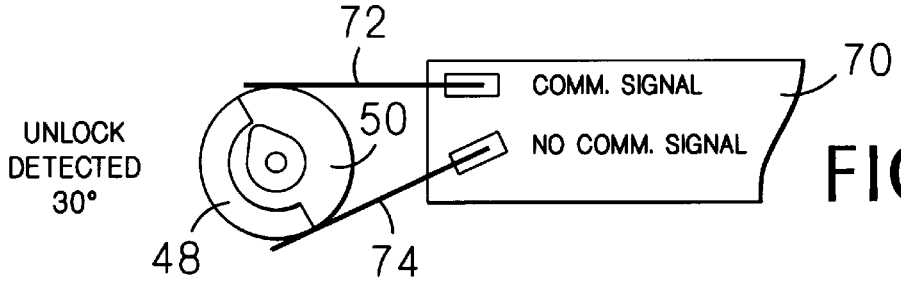
Figure 3C:
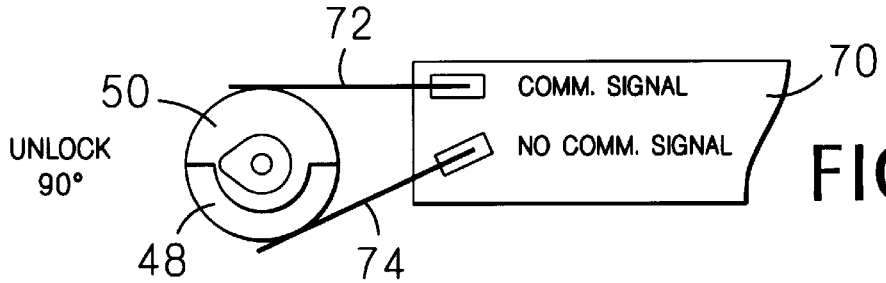
Figure 3D:
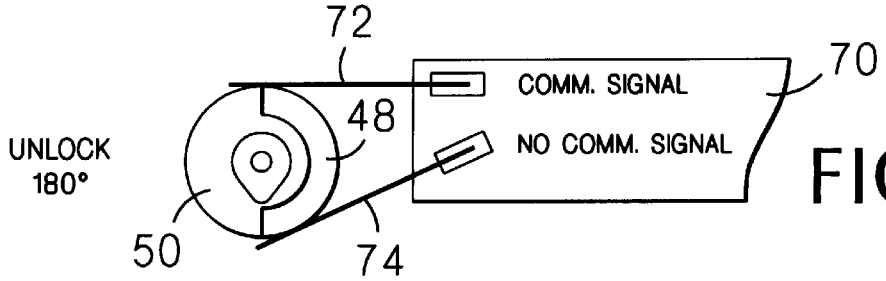

With continued reference to FIG. 1, two contact wires 72 and 74 are disposed so as to contact communication plate 50 for communication through a conductive post 130 on the communication plate, which conductive post electrically engages a contact pin on the key (not shown), as is described in the above-referenced application Ser. No. 08/395,417, for communication between the circuitry on board 70 and the key, as is also described in that application. The use of two contact wires 72 and 74 is used in the present invention to determine when lock 10 is in an unlocked position. FIG. 3A illustrates the position of communication plate 50 when lock 10 is in the locked position. Here, contact wires 72 and 74 complete an electrical path between board 70 and communication plate 50. When unlocking begins and the rotating components of lock 10 have been rotated about 30 degrees counterclockwise, as is shown on FIG. 3B, the electrical path is broken, since contact wire 74 no longer contacts communication plate 50, thus indicating an unlocked, or unlocking, condition. FIGS. 3C and 3D illustrate that no communication signal is received on contact wire 74 in either the 90-degree or 180-degree unlock positions. At all times, the communication signal is transmitted on contact wire 72.

Figure 5A:
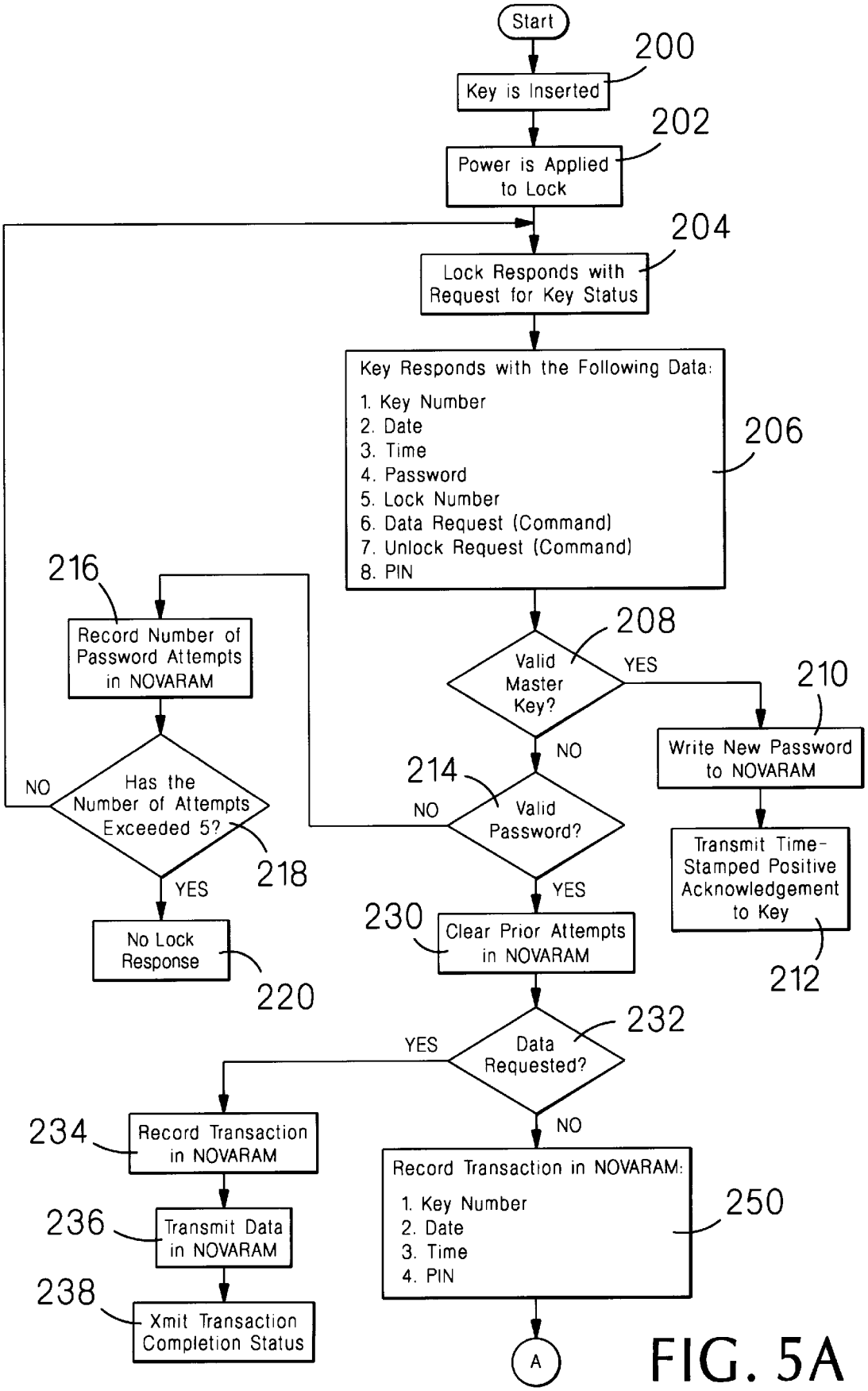
FIGS. 5A and 5B comprise a block logic diagram showing operation of the lock.
Figure 5B:
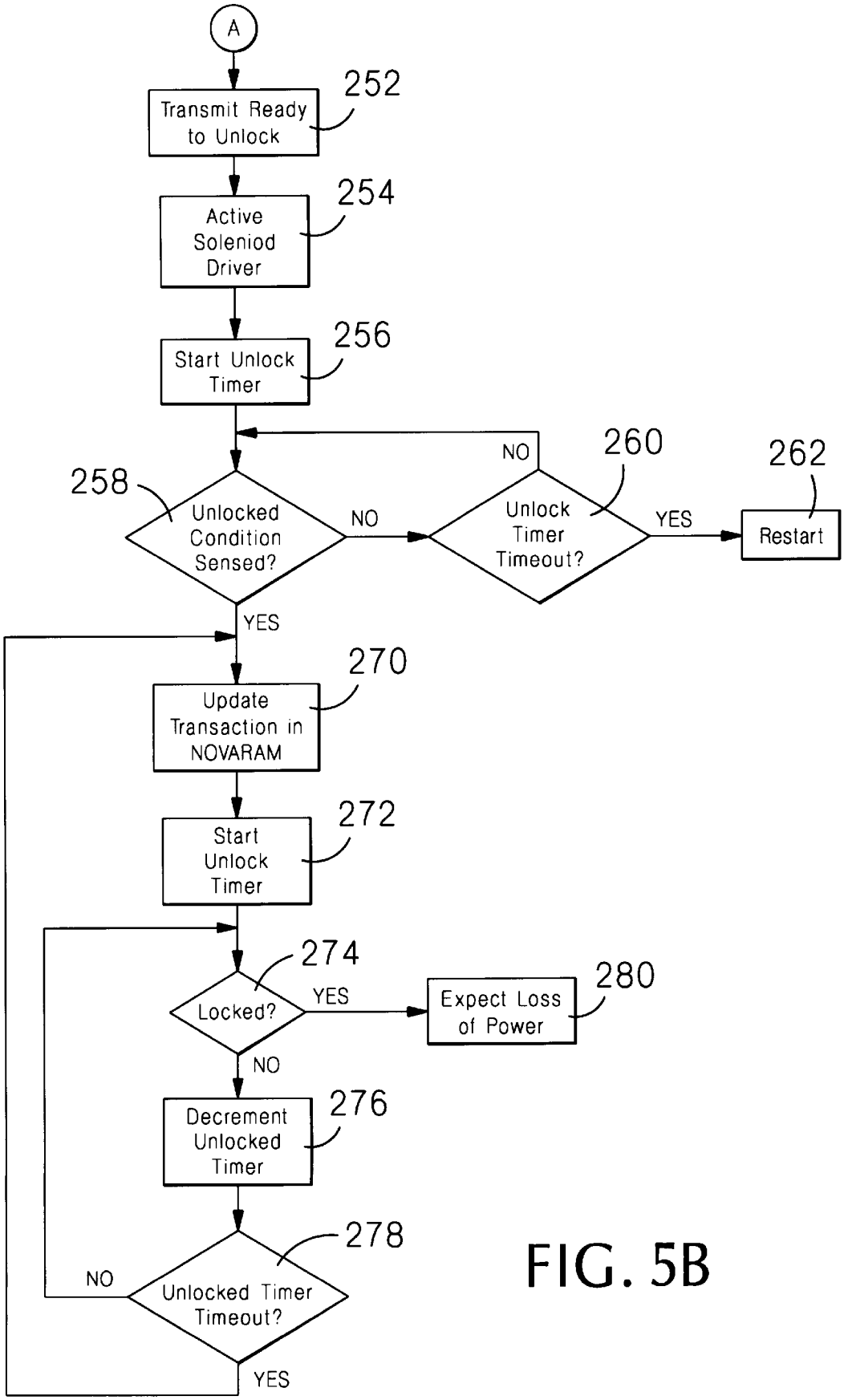

Reference should now be made to FIGS. 5A and 5B for an understanding of the method of the present invention for monitoring use of lock 10.

The present invention contemplates the use of three keys: a master key, an audit key, and a service key.

The master key is used to write a password to the memory of lock 10 or to change a previously written password. At step 200, the master key is inserted in lock 10, power is applied to the lock at step 202, the lock responds with a request for key status at step 204 and, at step 206, information is exchanged and an unlock command given by the key to the lock, all similar to the description in detail in application Ser. No. 08/395,417.

At step 208, lock 10 determines if the key is a valid master key. If yes, the new password is written to the non-volatile memory in lock 10, at step 210, and, at step 212, time-stamped positive acknowledgment is transmitted to the key.

If step 208 determines that the key is not a valid master key, that is, it is an audit key, a service key, or an unauthorized key, step 214 determines if the password given by the key is valid. If the password is not valid, step 216 records the number of password attempts in the memory of lock 10 and step 218 determines if the number of attempts has exceeded five. If the number of attempts has exceeded 5, step 220 terminates lock responses. If the number of attempts has not exceeded five, then the procedure returns to step 204. Permitting five attempts at access filters out errors due to noise, incorrect inputting of the user's PIN, and like events.

If step 214 determines that the password is valid, step 230 clears from memory the number of prior attempts with this key. Step 232 then determines if data is requested. If data is requested, that signifies that this key is an audit key and step 234 records the fact in memory. Then the data in memory as to who unlocked lock 10, when the lock was unlocked, and for how long the lock was unlocked is transmitted to the key at step 236 and step 238 transmits a transaction completion status.

If step 232 determines that data is not requested, that signifies that the key is a service key and step 250 records in memory the key number, the date, the time, and the PIN of the user. Step 252 transmits a ready to unlock signal, solenoid 80 (FIG. 1) is activated at step 254, and an unlock timer is started at step 256. Step 258 continuously senses whether there is an unlocked condition and if it is not and step 260 determines that the unlock timer has not yet reached timeout, step 258 continues to look for unlock. If timeout is reached before unlock, the unlocking procedure is aborted and step 262 requires that the unlocking procedure restart.

When step 258 senses that lock 10 is unlocked (FIG. 3B), the transaction is noted in memory at step 270 and an unlocked timer is started at 272. Step 274 continuously detects if lock 10 is locked and, if not, the unlocked timer is periodically decremented at step 276. If unlocked timer timeout is not found at step 278, the unlocked timer continues to be decremented until timeout. Then, memory is updated at step 270 and the procedure reiterated until lock 10 is locked. This particular procedure is employed to minimize the amount of memory used. A clock signal may be received from the key for use by the unlock and unlocked timers. When step 274 determines that lock 10 is locked, step 280 advises the microprocessor to expect loss of power.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. With a system employing an electronic lock and electronic key means, a method, comprising:

(a) providing as said electronic key means an electronic key selected from the group consisting of a master key, an audit key, and a service key;

when said master key is selected as said electronic key means;

(b) connecting said master key to said electronic lock;

(c) then, said electronic lock inquiring as to status of said master key to determine if said master key is a valid master key; and (d) then, when valid, said master key causing a password to be written to a memory in said electronic lock;

when said audit key is selected as said electronic key means;

(e) connecting said audit key to said electronic lock;

(f) then, said audit key transmitting a password to said electronic lock; and (g) then, provided said audit key has presented a valid password to said electronic lock, said electronic lock transmitting to said audit key first identification information;

when said service key is selected as said electronic key means;

(h) connecting said service key to said electronic lock;

(i) then, said service key transmitting to said electronic lock second identification information; and (j) then, said electronic lock becoming unlocked;

and said master key and said audit key being unable to unlock said electronic lock.

2. A method, as defined in claim 1, further comprising: providing as said first identification information one or more items selected from the group consisting of who unlocked said electronic lock, when said electronic lock was unlocked, and for how long said electronic lock was unlocked.

3. A method, as defined in claim 1, further comprising: providing as said second identification information one or more items selected from the group consisting of a key number, a date, a time, and a PIN of a user.

4. A method, as defined in claim 1, further comprising: repeating step (f) until said lock recognizes a valid password, up to a predetermined number of repetitions of step (f).

5. A method, as defined in claim 1, further comprising: following step (d), said electronic lock providing to said master key a time-stamped positive acknowledgment of receipt of said password.

6. A method of monitoring use of an electronic lock, comprising:

(a) storing in memory in said electronic lock information as to who opened said lock, when said lock was opened, and for how long said electronic lock was opened; and (b) subsequently using an electronic audit key to transfer said information from said memory to said audit key;

and said audit key being unable to unlock said electronic lock.

7. With a system employing an electronic lock and electronic key means, a method, comprising:

(a) providing as said electronic key means an electronic master key;

(b) then, connecting said master key to said electronic lock;

(c) then, said electronic lock inquiring as to status of said master key to determine if said master key is a valid master key;

(d) then, when valid, said master key causing a password to be written to a memory in said electronic lock; and (e) then, said electronic lock providing to said master key a time-stamped positive acknowledgment of receipt of said password.

* * * * *